US007540830B2

(12) United States Patent
Hildebrandt et al.

(10) Patent No.: US 7,540,830 B2
(45) Date of Patent: Jun. 2, 2009

(54) LEG STABILIZATION DEVICE

(75) Inventors: Mark Hildebrandt, Saline, MI (US); Roger Fettes, Ann Arbor, MI (US); Douglas Hennigar, Ann Arbor, MI (US)

(73) Assignee: Nustep, Inc., Ann Arbor, MI (US)

( * ) Notice: Subject to any disclaimer, the term of this patent is extended or adjusted under 35 U.S.C. 154(b) by 0 days.

(21) Appl. No.: 11/544,336

(22) Filed: Oct. 6, 2006

(65) Prior Publication Data

US 2008/0096731 A1 Apr. 24, 2008

(51) Int. Cl.

| | |
|---|---|
| ***A63B 69/16*** | (2006.01) |
| ***A63B 22/08*** | (2006.01) |
| ***A63B 71/00*** | (2006.01) |
| ***A61F 5/00*** | (2006.01) |

(52) U.S. Cl. ..... 482/57; 482/51; 482/139; 602/23

(58) Field of Classification Search ..... 482/57, 482/124, 904, 907, 908, 51, 133, 135, 136, 482/139; 601/33–4, 36, 34; 602/23, 26
See application file for complete search history.

(56) References Cited

U.S. PATENT DOCUMENTS

| | | | | |
|---|---|---|---|---|
| 1,663,921 | A * | 3/1928 | Pierce | 602/40 |
| 3,756,227 | A * | 9/1973 | Sager | 602/23 |
| 4,478,213 | A * | 10/1984 | Redding | 601/26 |
| 4,599,996 | A * | 7/1986 | Seith et al. | 601/34 |
| 4,608,971 | A * | 9/1986 | Borschneck | 602/23 |
| 4,624,458 | A | 11/1986 | Fendrik | |
| 4,685,351 | A | 8/1987 | Pegg | |
| 4,867,441 | A * | 9/1989 | Blakeman | 482/57 |
| 4,964,628 | A | 10/1990 | Poplawski | |
| 5,284,131 | A * | 2/1994 | Gray | 601/36 |
| 5,768,702 | A | 6/1998 | Kim | |
| 5,788,618 | A | 8/1998 | Joutras | |
| 5,954,622 | A * | 9/1999 | Olschansky et al. | 482/123 |
| 6,010,434 | A | 1/2000 | Hodges | |
| 6,447,428 | B1 | 9/2002 | McKillip | |
| 6,936,020 | B2 * | 8/2005 | Davis | 602/16 |
| 2006/0064044 | A1 * | 3/2006 | Schmehl | 601/34 |

* cited by examiner

*Primary Examiner*—Loan H Thanh
*Assistant Examiner*—Allana Lewin
(74) *Attorney, Agent, or Firm*—Brinks Hofer Gilson & Lione

(57) ABSTRACT

A system for stabilizing a leg of a user includes a rail having a first end and a second end. The rail generally defines a longitudinal axis extending between the first end and the second end. The first end is capable of being connected to an anchor point while the second end is capable of being connected to a portion of the leg located between the knee and the hip of the leg.

6 Claims, 5 Drawing Sheets

LEG STABILIZATION DEVICE

BACKGROUND OF THE INVENTION

1. Field of the Invention

The present invention generally relates to leg stabilization devices for aiding in the operation of exercise and health care equipment.

2. Description of the Known Technology

Exercise equipment requires a user to properly operate the equipment in order to obtain the intended health benefits while maintaining good form. Exercise equipment, such as a recumbent cross trainer; engage both the feet of the user via foot pedals and the hands of the users via handlebars. To exercise, the user's feet simply press the pedals or push and pull the handlebars of the exercise equipment in a repetitive fashion. If done properly, the user obtains the intended health benefits while maintaining good form.

A common situation can occur with individuals' lower body function who suffer from neurological, or neuromuscular disabilities, head injuries, muscular weakness, paralysis, spasticity, and even individuals with too much muscle tone due to a disability: they simply cannot maintain good leg alignment while pressing the pedals of the exercise equipment and their legs can abduct and/or adduct during the exercise motion. This lack of good form or alignment inhibits proper use of the equipment as well as limiting rehabilitation of the lower body, limiting overall cardiovascular conditioning of the user, and even limiting the ability of the neuromuscular system to retrain itself in performing activities of daily living.

Currently, other harness devices, sometimes referred to as "boots" attach to a users foot, ankle, and/or calf to help keep the leg aligned during movement and prevent abduction and/or adduction. The boot attaches to the pedals and substantially encloses portions of the user's foot and calf. However, by attaching these devices to a user's lower extremities below the knee, the prime muscle movers of the leg and hip can impart a torque to the knee, whereby the prime muscle movers are pushing the upper portion of the leg in one direction, while the boot device restrains the lower portion of the leg from moving in that same direction. A torque that is created on the knee can potentially cause injury to the ligaments that help to support and stabilize the knee during movement.

Additionally, these boot and related devices do little to adjust for the desired leg alignment in that they provide one position that the user has to adjust their leg and body to, versus having the device adjust to the desired alignment of the user, which may vary slightly from user to user depending on the disability of the user. Good alignment reduces the amount of torque to the knee by keeping the knee inline with the equipment's pedals or in a desired alignment that the user can actually tolerate, and thereby placing most of the force inline with the knee and minimizing the torque applied.

Finally, other devices such as stretchy bands, gait belts, or straps are also used to attempt to provide good form and leg alignment, but these are limited in function since they serve other purposes and are not intended to correct leg abduction or adduction as their primary function. Therefore, there exists a need for a better solution that provides good form and leg alignment, that provides the ability to adjust the alignment to a user, and that prevents potential knee torque that can occur when operating exercise equipment.

BRIEF SUMMARY OF THE INVENTION

In overcoming the drawbacks and limitations of the known technology a leg stabilization device and method of use is disclosed. The leg stabilization device includes a rail having a first end and a second end. The rail generally defines a longitudinal axis extending between the first end and the second end. The first end is capable of being connected to any anchor point while the second end is capable of being connected to a portion of the leg located between the knee and the hip of the leg.

The leg stabilization device may also include a C-clamp and collar connected to the first and second ends of the leg stabilization device, respectively. The C-clamp is rotatably connected to the first end of the leg stabilization device, allowing at least one axis of rotation. Similarly, the collar is connected to the second end of the leg stabilization device allowing at least one axis of rotation.

The method for using the leg stabilization device includes the steps of attaching the first end of the leg stabilization device to an anchor point and attaching the second end of the leg stabilization device to a portion of a leg, the portion of the leg being between the knee and the hip of the leg. Additionally, the method may include the additional steps such as adjusting the collar and/or the C-clamp along at least one axis of rotation.

An alternative method involves attaching the device to the seat and/or other stationary or non stationary object to provide an anchor point of origin from which to operate the device.

Additional benefits and advantages of the present invention will become apparent to those skilled in the art to which the present invention relates from the subsequent description of the preferred embodiment and the appended claims, taken in conjunction with the accompanying drawings.

DETAILED DESCRIPTION OF THE INVENTION

Figure 1:
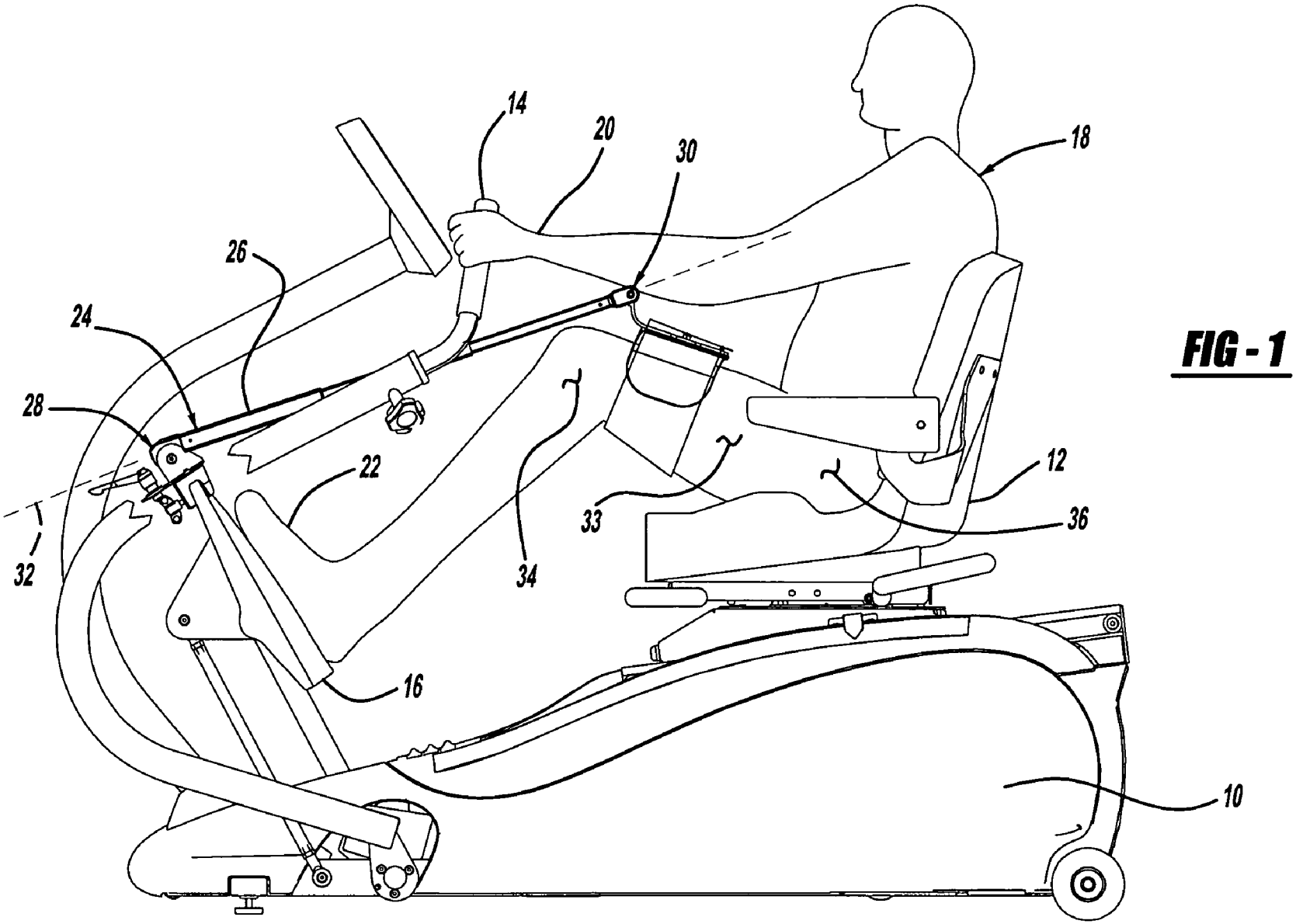
FIG. 1 is a perspective view of a recumbent cross-trainer having a leg stabilization device in accordance with one embodiment of the present invention.

Referring to FIG. 1, a recumbent cross-trainer 10 is shown. The recumbent cross-trainer 10 includes a seat 12, at least one handle bar 14, and at least one pedal 16. Generally, the recumbent trainer 10 will include two handle bars and two pedals. A user 18 sitting on the seat 12 engages the recumbent cross-trainer 10 by gripping the handle bar 14 with the user's hand 20 and engaging the pedal 16 with the user's foot 22 in a repetitive back and forth motion.

Also shown is a leg stabilization device 24 including a rail 26 having a first end 28 and a second end 30. The first end 28 and the second end 30 are generally opposed and define a longitudinal axis 32 along the length of the rail 26. Generally, the first end 28 of the rail 26 is connected to the pedal 16. However, the rail 26 may be structurally altered allowing the first end 28 to connect to any anchor point capable of supporting the leg stabilization device 24, such as the seat 12. The second end 30 of the rail 26 is connected to a portion 33 of the leg of the user 18. The portion 33 of the leg is located between the knee 34 and the hip 36.

It should be understood that the anchor point may be any stationary or non stationary point capable of supporting the leg stabilization device 24. As stated previously, the anchor point may be the pedal 16, the seat 12 or any portion of the recumbent cross-trainer 10. However, the anchor point may be a point that does not include any portion of the recumbent cross-trainer 10.

Figure 2:
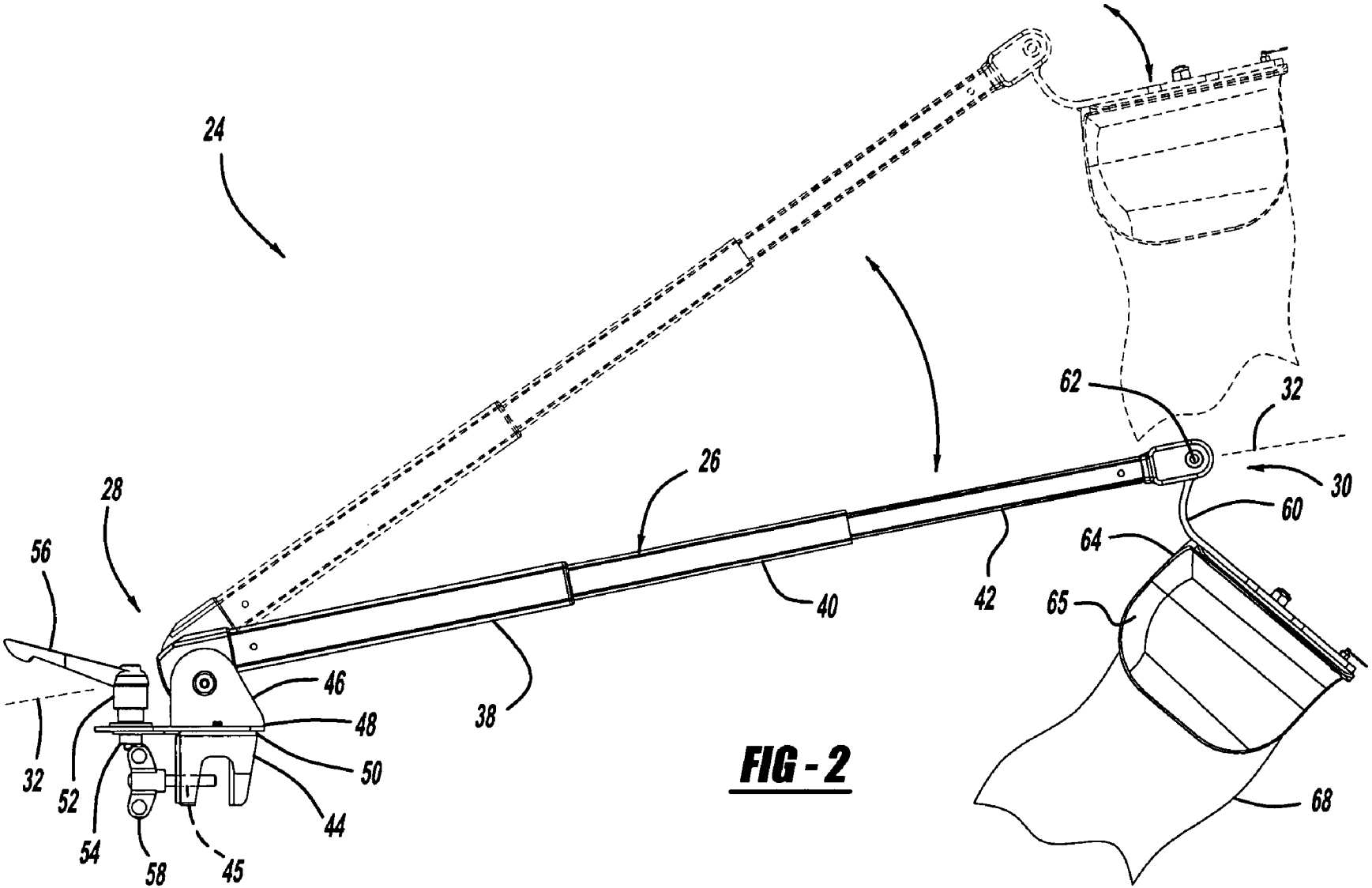
FIG. 2 is a perspective view of the leg stabilization device shown in FIG. 1.

Referring to FIG. 2, a side view of the leg stabilization device 24 is shown. In this embodiment, the rail 26 includes a first, second, and third sections 38, 40 and 42. The first and second sections, 38 and 40, are connected to each other in a telescopic fashion. More specifically, the second section 40 can be retracted or extended from the interior of the first section 38. Similarly, the second section 40 and the third section 42 are connected to each other in a telescopic fashion, whereby the third section 42 can extend and retract into the interior of the second section 40. As such, during operation, the second section 40 and third section 42 can be locked into place by frictional or locking engagement. Alternatively, the second section 40 and third section 42 may be allowed to extend and retract freely.

Rotatably connected to the first end 28 of the rail 26 is a C-clamp 44. The C-clamp 44 is connected to the first end 28 via a hinge 46. The C-clamp 44 can rotate about an axis substantially perpendicular to the longitudinal axis 32. The C-clamp 44 includes at least one wing bolt 58. The wing bolt 58 is inserted through a threaded hole 45 in the C-clamp 44. The wing bolt 58 may be adjusted to allow the C-clamp 44 to attach onto a variety of different connection anchor points such as the pedal 16 (as best shown in FIG. 1).

Additionally, a first and second plate 48, 50 may be located between the hinge 46 and the C-clamp 44. The first plate 48 is connected to the hinge 46 and the second plate 50 is connected to the C-clamp 44. The first and second plates 48, 50 may then be sandwiched together by a bolt 52 and a nut 54 combination.

Attached to the second end 30 is an L-shaped bracket 60. The L-shaped bracket 60 is attached to the second end 30 via a pivot pin 62, thereby allowing the L-shaped bracket 60 to rotate on/about an axis substantially perpendicular to the longitudinal axis 32. The L-shaped bracket 60 is attached to a collar 64 ergonomically contoured to engage the portion 33 of the leg of the user 18 (as best shown in FIG. 1). A removable pad 65 may be attached to the collar 64, such that the removable pad is located between the collar 64 and the portion 33 of the leg of the user 18. Attached to the collar 64 is a strap 68. The strap 68 can wrap around the leg 33 of the user 18 thereby coupling the portion 33 of the leg to the collar 64.

Figure 3:
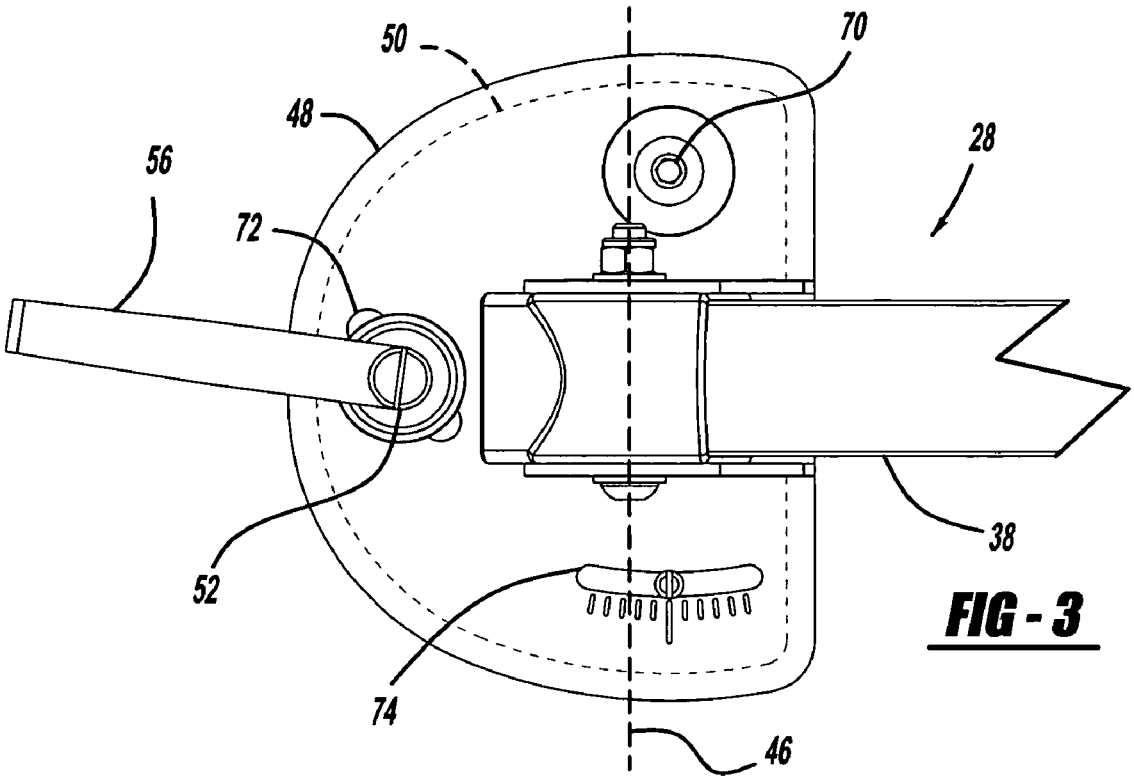
FIG. 3 is a top view of a C-clamp of the leg stabilization device.
Figure 5:
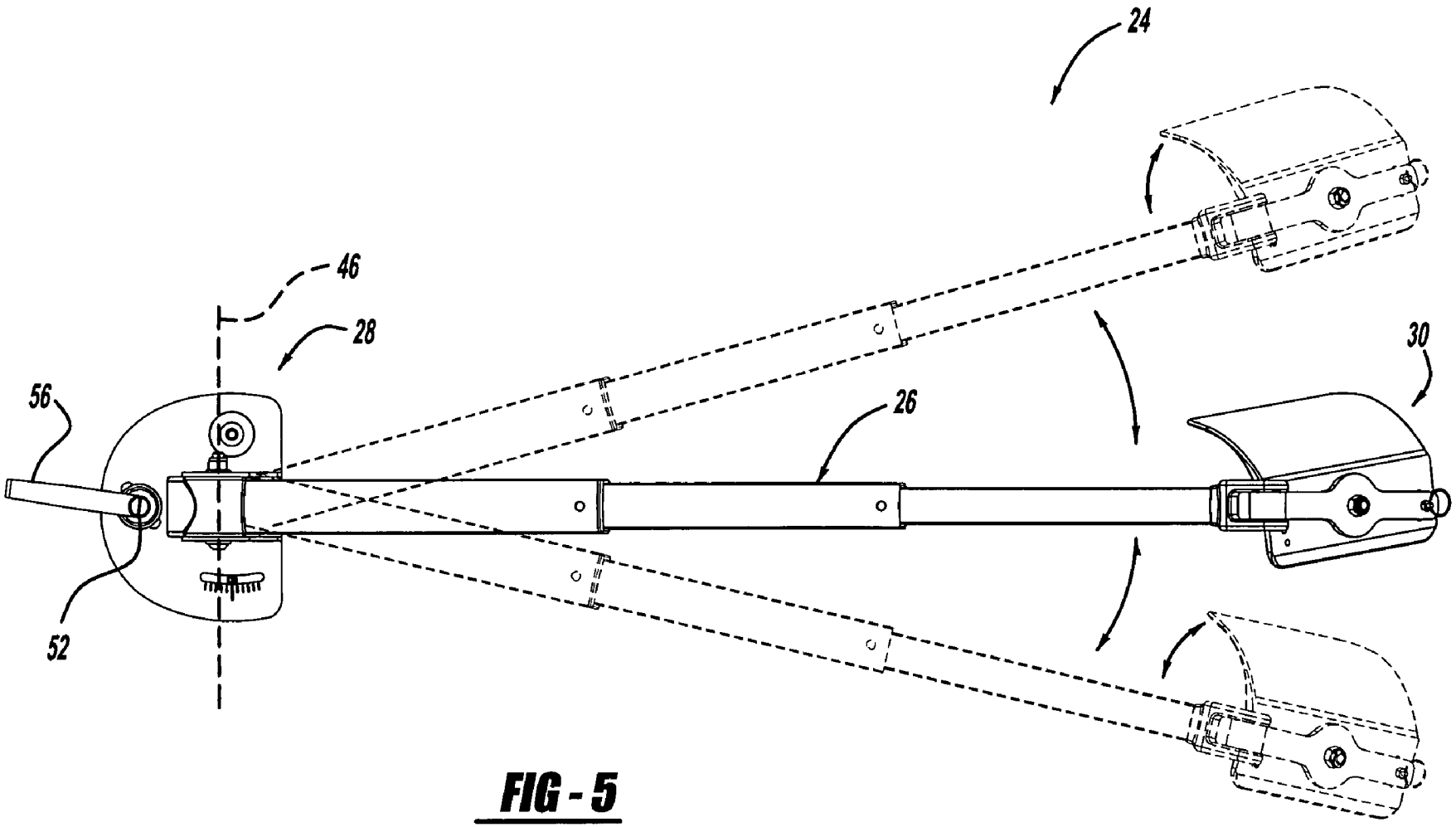
FIG. 5 is a top view of the leg stabilization device shown in FIG. 1.

Referring to FIGS. 3 and 5, a more detailed view of the first end 28 of the leg stabilization device 24 is shown. As stated previously, the first end 28 is attached to a hinge 46. The handle 56 is used to engage the first plate 48 to the second plate 50 through bolt 52. A first end retaining bolt 70 extends through both the first and second plates 48, 50, thereby providing an axis in which the first and second plates 48, 50 rotate about. For example, when the handle 56 is engaged in a tightening fashion, the first and second plate will be sandwiched together by bolt 52, thereby preventing movement about the axis defined by retaining bolt 70. When the handle 56 is engaged in a loosening fashion, the first and second plates 48, 50 will no longer be sandwiched together, thereby allowing movement about the axis defined by retaining bolt 70. A slot 72, defined within the first plate, limits this axis of rotation while an indicator 74 indicates the position of the first plate 48 in relation to the second plate 50.

Figure 4:
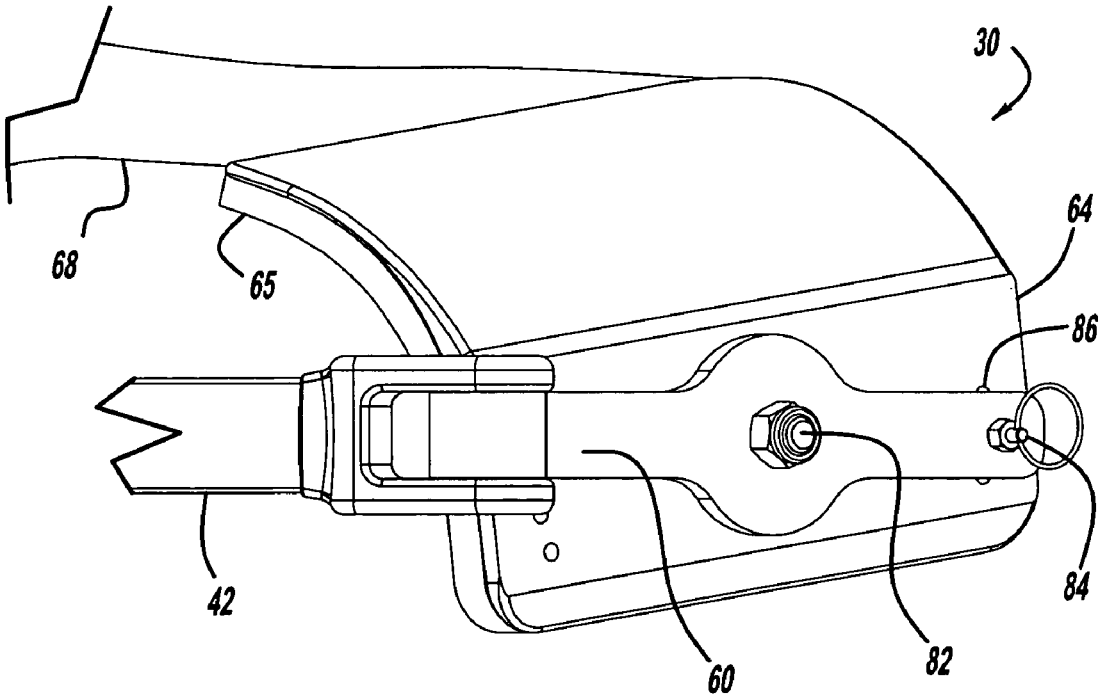
FIG. 4 is a top view of a bracket for the leg stabilization device.

Referring to FIG. 4, a more detailed view of the second end 30 of the leg stabilization device 24 is shown. The L-shaped bracket 60 is attached to the collar 64 via a retaining bolt 82. The retaining bolt 82 allows the collar 64 to rotate relative to the L-shaped bracket 60. A pin 84 extends from the L-shaped bracket 60 into a series of holes or slot 86 of the collar 64. The pin 84 and the holes or slot 86 limit the rotation of the collar 64 with respect to the L-shaped bracket 60.

Figure 6:
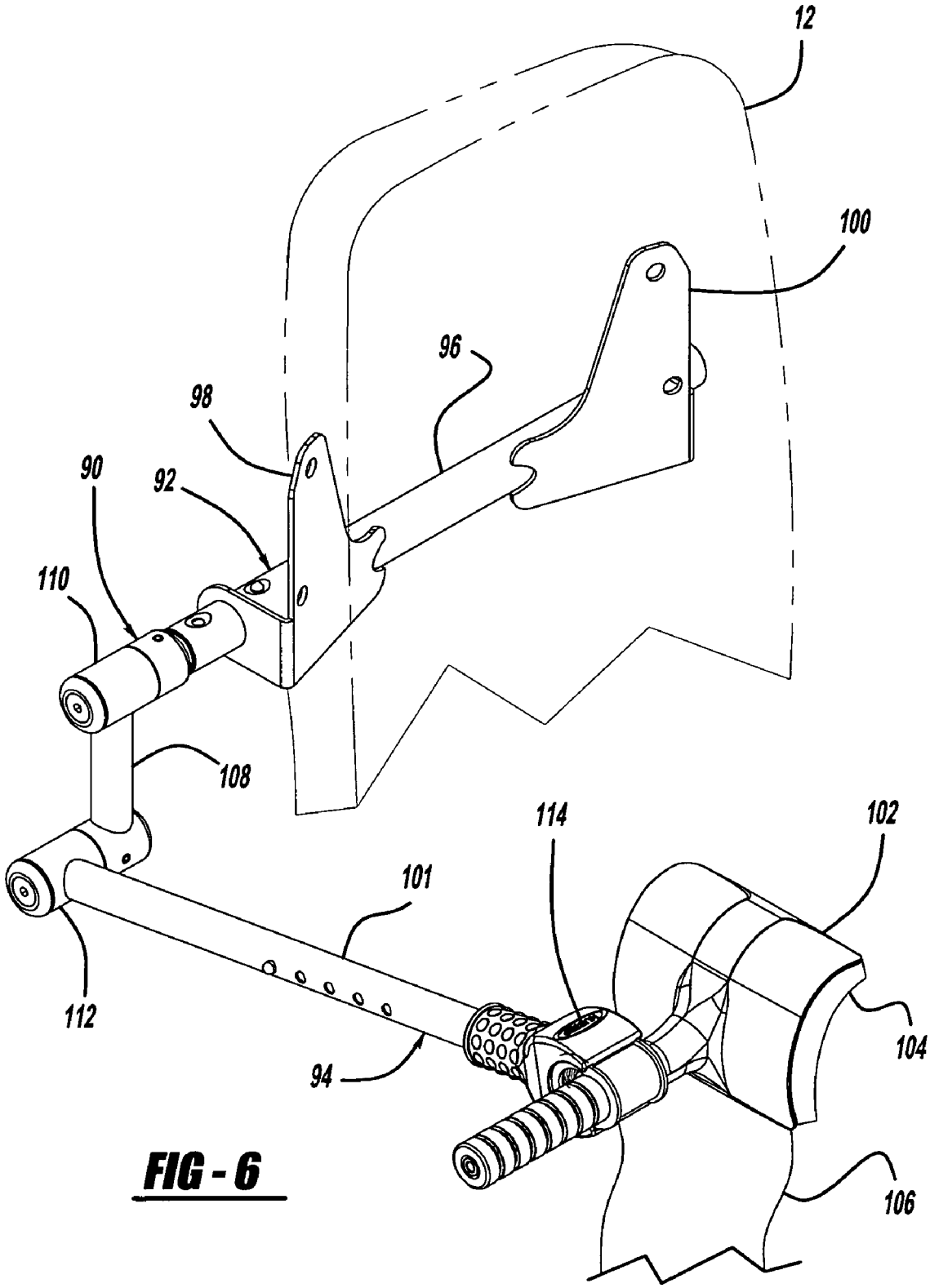
FIG. 6 is a perspective view of leg stabilization device in accordance with another embodiment of the present invention.

Referring to FIG. 6, a second embodiment of a leg stabilization device 90 is shown. For illustrative purposes, the seat 12 of the recumbent cross-trainer 10 shown in FIG. 1 is shown in FIG. 6. It should be understood that description of the recumbent cross-trainer 10 of the previous paragraphs is equally applicable in this embodiment. Generally, the leg stabilization device 90 includes a first end 92 and a second end 94. The first end 92 is connected to the seat 12 of the recumbent cross-trainer 10. Similar to the embodiment shown in the previous figures, the second end 94 is connected to a portion of the leg of the user located between the knee and the hip.

The first end 92 includes a first end rail 96. Attached to the first end rail 96 are generally opposed first and second brackets 98 and 100. The first and second brackets 98 and 100 are fixedly attached to a portion of the seat 12 of the recumbent cross-trainer 10. Here, the leg stabilization device 90 is attached to the back portion of the seat 12. However, it should be understood that the leg stabilization accessory 90 may be attached to any portion of the seat 12 or other stationary or non stationary anchor point.

The second end 94 includes a second end rail 101 attached to a collar 102. In order to accommodate the user, the second end rail is telescopically adjustable and is pivotally connected to the collar 102 via a pivot point 103.

The collar 102 is similar to the previously described collar 64. The collar 102 is ergonomically contoured and flexible to engage a portion of the leg of a user. A removable pad 104 may be attached to the collar 102 such that the removable pad is located between the collar 102 and the portion of the leg of the user. Also attached to the collar 102 is a strap 106. The strap 106 can wrap around the leg of a user thereby coupling the portion of the leg of the user to the collar 102. A lock 114 engages rings of pivot point 103 to enable locking the position of collar 102 the leg of the user.

Connecting the first end rail 96 to the second end rail 101 is a bridge 108. Pivot points 110 and 112 connect the bridge 108 to the first end rail 96 and second end rail 101, respectively. The pivot points 110 and 112 articulate freely, thereby allowing the second end rail 101 and collar 102 to comfortably engage the portion of the leg of the user in good position and alignment.

While the above description constitutes the preferred embodiment of the present invention, it will be appreciated that the invention is susceptible to modification, variation, and change without departing from the proper scope and fair meaning of the accompanying claims.

The invention claimed is:

1. A device for stabilizing a leg of a user, the device comprising:

a first link having a first end and a second end, the first link generally defining a longitudinal axis extending between the first end and the second end;

a second link having a first end and a second end;

the first and second links being rotatably coupled to each other at a first pivot point, the first pivot point being located at first ends of the first and second links, the first pivot point defining a first axis of rotation;

a collar rotatably coupled to the second end of the first link at a second pivot point, the second pivot point defining a second axis, wherein the collar rotates about the second axis of rotation; and the collar being configured to be connected to a portion of the leg, the portion of the leg being between the knee and the hip of the leg;

the second end of the second link being rotatably attached to a stationary anchor point at a third pivot, the third pivot defining a third axis of rotation, wherein the second link rotates about a third axis; and wherein the stationary anchor point is a portion of an exercise machine.

2. The device of claim 1, wherein the first axis and the third axis are substantially parallel.

3. The device of claim 2, wherein the first axis, the second axis, and the third axis are substantially parallel.

4. The device of claim 1, wherein the first axis and the third axis are each substantially perpendicular to the longitudinal axis.

5. The system of claim 1, wherein the portion of the exercise machine is a portion of a seat of the exercise machine.

6. The device of claim 5, wherein the portion of the seat is a back portion of the seat.

* * * * *